US007730647B2

(12) United States Patent
Kubo et al.

(10) Patent No.: US 7,730,647 B2
(45) Date of Patent: Jun. 8, 2010

(54) CONSTRUCTION MACHINE

(75) Inventors: Yoshiteru Kubo, Fukuoka (JP); Sachio Shimizu, Saitama (JP); Shinichi Senba, Saitama (JP); Hiroyuki Takayama, Saitama (JP); Kouhei Urase, Shiga (JP); Takaharu Nishimura, Shiga (JP)

(73) Assignee: Komatsu Utility Co., Ltd., Tokyo (JP)

( * ) Notice: Subject to any disclaimer, the term of this patent is extended or adjusted under 35 U.S.C. 154(b) by 0 days.

(21) Appl. No.: 10/848,411

(22) Filed: May 19, 2004

(65) Prior Publication Data

US 2004/0244230 A1 Dec. 9, 2004

(30) Foreign Application Priority Data

May 20, 2003 (JP) ..... 2003-142568
May 20, 2003 (JP) ..... 2003-142569
Apr. 7, 2004 (JP) ..... 2004-113294

(51) Int. Cl.
*E02F 3/58* (2006.01)
*B62D 21/00* (2006.01)

(52) U.S. Cl. ..... 37/397; 37/231; 280/781; 180/89.13; 180/9.1

(58) Field of Classification Search ..... 37/412, 37/466, 397, 348, 231; 180/9.52, 9.23, 9.1, 180/9.44, 9.5, 89.12, 89.13; 89/12; 212/180, 212/181, 175; 280/781, 797, 798, 793; 414/687, 414/723

See application file for complete search history.

(56) References Cited

U.S. PATENT DOCUMENTS 1,918,771 A * 7/1933 Meyer ..... 37/231
2,351,799 A * 6/1944 Austin ..... 172/247
3,316,665 A * 5/1967 Rinaldo ..... 37/231
4,231,699 A * 11/1980 Thompson ..... 414/687
4,249,625 A * 2/1981 Palm ..... 180/6.7
4,324,304 A * 4/1982 Hashimoto et al. ..... 180/9.52
4,397,481 A * 8/1983 Dion et al. ..... 280/781
4,650,017 A * 3/1987 Pelletier et al. ..... 180/9.1

(Continued)

FOREIGN PATENT DOCUMENTS

EP 1 033 448 A2 6/2000

(Continued)

OTHER PUBLICATIONS

Refusing Reasons Notice mailed on Apr. 14, 2009 from the Japanese Patent Office in the corresponding Japanese patent application No. 2004-113294 (with English translation).

*Primary Examiner*—Thomas A Beach
(74) *Attorney, Agent, or Firm*—Posz Law Group, PLC

(57) ABSTRACT

An object of the present invention is to provide a construction machine which precipitates the removal of earth that is churned up onto a vehicle body from the vehicle body, which reduces transfer loads on a blade bracket, which improves the attachability of the blade bracket, and which achieves standardization of the blade bracket. The construction machine according to the present invention is constituted such that a frame of a crawler belt-type traveling body comprises a center frame, a pair of truck frames disposed on the outside of two side portions of the center frame, a connecting member which connects the center frame to the truck frames, and a blade bracket which is joined to the center frame and the connecting member.

17 Claims, 10 Drawing Sheets

U.S. PATENT DOCUMENTS

| | | | | | |
|---|---|---|---|---|---|
| 5,074,370 | A | * | 12/1991 | Lindstrot et al. | 180/9.52 |
| 5,308,151 | A | * | 5/1994 | Sugden et al. | 299/73 |
| 5,337,847 | A | * | 8/1994 | Woods et al. | 180/9.52 |
| 6,105,699 | A | * | 8/2000 | Hinds | 180/89.14 |
| 6,158,539 | A | * | 12/2000 | Isley | 180/89.14 |
| 6,322,104 | B1 | * | 11/2001 | Duppong et al. | 280/781 |
| 7,204,518 | B2 | * | 4/2007 | Kubo et al. | 280/781 |
| 7,293,374 | B2 | * | 11/2007 | Fukushima | 37/397 |
| 7,338,081 | B2 | * | 3/2008 | Urase et al. | 280/781 |
| 2004/0232687 | A1 | * | 11/2004 | Kubo et al. | 280/781 |
| 2005/0172527 | A1 | * | 8/2005 | Mimuro et al. | 37/466 |

FOREIGN PATENT DOCUMENTS

| | | | |
|---|---|---|---|
| JP | 59-163663 | * | 11/1984 |
| JP | 62-59577 | | 8/1987 |
| JP | 05-179675 | | 7/1993 |
| JP | 09-111805 | | 4/1997 |
| JP | 09-202261 | | 5/1997 |
| JP | 11-93209 | | 6/1999 |
| JP | 2000-230252 | | 8/2000 |
| JP | 2001-254387 | | 9/2001 |
| JP | 2001-2541387 | | 9/2001 |
| JP | 2002-138510 | | 5/2002 |
| JP | 2002-178960 | | 6/2002 |
| JP | 2003-056005 | | 2/2003 |
| JP | A-2003-048577 | | 2/2003 |
| WO | WO 03/042022 | A1 | 5/2003 |
| WO | WO 2004/033273 | A1 | 4/2004 |

* cited by examiner

CONSTRUCTION MACHINE

BACKGROUND OF THE INVENTION

1. Field of the Invention

The present invention relates to a construction machine such as a hydraulic shovel, and more particularly to a frame constitution of a traveling body in a construction machine.

2. Description of the Related Art

A conventional hydraulic shovel 100 disclosed in "Crawler-type Vehicle" (Japanese Unexamined Patent Application Publication 2002-178960) comprises a traveling body 101 to enable movement, and a slewing body 102 which is mounted slewably above the traveling body 101, as shown in FIG. 9.

The slewing body 102 comprises a slewing frame 103, and the slewing frame 103 is provided with a body cover 104 accommodating a motor and the like, a cab 105 which defines the operating cabin, a counterweight 106, and so on, for example.

A working device 107 is provided elevatably at the front portion of the slewing body 102.

A truck frame 108 constituting the main body part of the traveling body 101 is, as shown in FIG. 10, constituted by a center frame 109 positioned in the center by means of steel plate welding or the like, and side frames 112 provided on both the left and right sides of the center frame 109 and extending to the front and rear.

Here, the center frame 109 is constituted by a central circular core 110, and leg parts 111 extending in a front/rear direction and a left/right direction from the outer periphery of the circular core 110 to form an overall H shape.

The leg parts 111 are formed as canning structures by an upper plate portion 111A, a lower plate portion 111B, side plate portions 111C which connect the plate portions 111A, 111B in a vertical direction, and so on.

112, 112 are left and right side frames provided on the tip end side of the leg portions 111 of the center frame 109 by welding. The side frames 112 are formed as frame bodies in a substantially reverse C shape extending in a front/rear direction.

Left and right mudguard covers 125, 125 are disposed respectively on the side frames 112, 112 of the truck frame 108.

Note that "Truck Frame for Construction Machine" (Japanese Unexamined Patent Application Publication H9-202261) is disclosed as another known invention in addition to that described above.

The hydraulic shovel 100 described above (see FIG. 9) travels over various types of ground by driving crawler belts 117 disposed on the traveling body 101 to rotate. As a result, earth, mud, and so on are churned up by the crawler belts 117.

Here, as shown in FIGS. 9, 10, the mudguard covers 125, 125 provided in the vicinity of the crawler belts 117, 117 are constituted so as to extend in a horizontal direction, and hence the earth, mud, and so on that are churned up by the crawler belts 117 may accumulate on top of the mudguard covers 125, 125.

In this case, a worker must remove the accumulated earth, mud, and so on, and if the earth, mud, and so on are left to accumulate, they cause running resistance when the hydraulic shovel 100 is operated.

Hence a blade bracket (not shown) on which an earth-removing blade (not shown) is supported so as to swing freely is connected to the front portion of the traveling body 101.

As the blade performs an earth removal operation, various loads such as large loads are applied to the blade bracket which supports the blade. It is therefore desirable that an operating load transmitted to the blade bracket be processed appropriately in order to improve the load-withstanding strength of the vehicle body.

SUMMARY OF THE INVENTION

The present invention has been designed in consideration of this situation, and it is an object thereof to provide a construction machine which precipitates the removal of earth that is churned up onto a vehicle body from the vehicle body, to reduce the transfer load on a blade bracket, to improve the attachability of the blade bracket, and to achieve standardization of the blade bracket.

In a construction machine according to a first invention, a frame of a crawler belt-type traveling body comprises a center frame, a pair of truck frames disposed on an outside of two side portions of the center frame, a connecting member which connects the center frame to the truck frames, and a blade bracket which is joined to the center frame and the connecting member.

According to this constitution, the center frame and truck frames are connected by the connecting member, and hence earth that is churned up onto the vehicle body can be caused to drop off the vehicle body favorably.

Moreover, the blade bracket is joined to the center frame and connecting member, and hence the width of the blade bracket can be increased. As a result, operating loads acting on the blade can be received on the wide blade bracket, leading to an improvement in the load-withstanding strength.

In a construction machine according to a second invention, which pertains to the first invention, a joining face of the center frame to which the blade bracket is joined and a joining face of the connecting member to which the blade bracket is joined form a single plane.

According to this constitution, the joining face of the center frame and the joining face of the connecting member to which the blade bracket is joined form a single plane, and hence when joining is performed by welding, straight line welding is possible, thus simplifying the welding operation.

In this case, the blade bracket is welded securely to the center frame and connecting member, and hence the joining strength is increased, leading to an improvement in mechanical reliability.

Joining is also performed easily when the blade bracket is joined using bolts.

Further, since the joining face of the center frame and the joining face of the connecting member to which the blade bracket is joined form a single plane, operating loads acting on the blade can be dispersed smoothly over the vehicle body, leading to an increase in the load-withstanding strength of the vehicle body and an improvement in mechanical reliability.

Furthermore, since the joining portion of the blade bracket is planar, the form of the blade bracket can be simplified, leading to a reduction in manufacturing costs.

Moreover, the blade bracket, which is joined to a center frame for a large machine model, may also be applied to a center frame for a small machine model, and hence standardization of the blade bracket is achieved.

This also contributes to a reduction in the manufacturing costs of the construction machine.

In a construction machine according to a third invention, which pertains to the first invention, a joining face of the center frame to which the blade bracket is joined and a joining face of the connecting member to which the blade bracket is joined form a stepped portion.

According to this constitution, the center frame and truck frames are connected by the connecting member, and hence earth that is churned up onto the vehicle body can be caused to drop off the vehicle body favorably.

Moreover, the blade bracket is joined to the center frame and connecting member, and hence the width of the blade bracket can be increased. As a result, operating loads acting on the blade can be received on the wide blade bracket, leading to an improvement in the load-withstanding strength.

In a construction machine according to a fourth invention, which pertains to the first invention, a joining face of the connecting member to which the blade bracket is joined forms a continuous surface such as a curved surface in relation to a joining face of the center frame to which the blade bracket is joined.

According to this constitution, the center frame and truck frames are connected by the connecting member, and hence earth that is churned up onto the vehicle body can be caused to drop off the vehicle body favorably.

Moreover, the blade bracket is joined to the center frame and connecting member, and hence the width of the blade bracket can be increased. As a result, operating loads acting on the blade can be received on the wide blade bracket, leading to an improvement in the load-withstanding strength.

In a construction machine according to a fifth invention, which pertains to any of the first through fourth inventions, the blade bracket is joined to the center frame and connecting member via an attachment member.

According to this constitution, the blade bracket is joined to the center frame and connecting member via the attachment member, and hence during the joining thereof by welding, the joining portion of the blade bracket is prevented from being welded to the welding location connecting the center frame to the connecting member.

Further, since the blade bracket is joined by welding to the center frame and connecting member via the attachment member, the joining strength of the blade bracket to the center frame and connecting member is increased, leading to an improvement in mechanical reliability.

The blade bracket is also joined to the center frame and connecting member via the attachment member when bolts are used therefor, and hence joining is performed easily.

Moreover, stress generated by a load that is transmitted from the blade bracket is dispersed upon transmission to the attachment member and then transmitted to the vehicle body, thus heightening the load-withstanding strength of the vehicle body to operating loads generated by the blade, and improving mechanical reliability.

A construction machine according to a sixth invention comprises a lower traveling body and an upper slewing body which slews freely in relation to the lower traveling body, a frame of the lower traveling body comprising a hollow center frame to which the upper slewing body is slewably attached, a pair of truck frames disposed on an outside of two side portions of the center frame, a hollow connecting member which connects the center frame to the truck frames, and a blade bracket which is joined to the center frame and the connecting member, the construction machine comprising: the center frame having a joining face at a front thereof to which the blade bracket is joined; and the connecting member having a joining face at a front thereof that is adjacent to the joining face of the center frame so as to form a single plane with the joining face of the center frame, to which the blade bracket is joined, wherein a joining portion of the blade bracket is aligned with the joining face of the center frame and the joining face of the connecting member and welded thereto, whereby the blade bracket is joined to the center frame and the connecting member.

According to this constitution, the joining face of the center frame and the joining face of the connecting member, to which the joining portion of the blade bracket is welded, form a single plane, thus enabling straight line welding such that welding can be performed easily.

Further, the blade bracket is welded securely to the center frame and connecting member, and hence the joining strength of the welding is increased, leading to an improvement in mechanical reliability.

Also, since the joining face of the center frame and the joining face of the connecting member, to which the joining portion of the blade bracket is welded, form a single plane, loads generated by the blade can be dispersed smoothly, leading to an increase in load-withstanding strength and an improvement in mechanical reliability.

Further, since the joining portion of the blade bracket can be constituted in planar form, the form of the blade bracket can be simplified, leading to a reduction in manufacturing costs.

Also, since the joining face of the center frame and the joining face of the connecting member, to which the joining portion of the blade bracket is welded, form a single plane, the blade bracket, which is joined to a center frame for a large machine model, may also be applied to a center frame for a small machine model, and hence standardization of the blade bracket is achieved.

This also contributes to a reduction in the manufacturing costs of the construction machine.

A construction machine according to a seventh invention comprises a lower traveling body and an upper slewing body which slews freely in relation to the lower traveling body, a frame of the lower traveling body comprising a hollow center frame to which the upper slewing body is slewably attached, a pair of truck frames disposed on an outside of two side portions of the center frame, a hollow connecting member which connects the center frame to the truck frames, and a blade bracket which is joined to the center frame and the connecting member, the construction machine comprising: a plate-form attachment member to which a joining portion of the blade bracket is welded; the center frame having a joining face at the front thereof to which the plate-form attachment member is welded; and the connecting member having a joining face at a front thereof that is adjacent to the joining face of the center frame so as to form a single plane with the joining face of the center frame, to which the plate-form attachment member is welded, wherein the blade bracket is welded to the center frame and the connecting member via the plate-form attachment member.

According to this constitution, the blade bracket is welded to the center frame and connecting member via the attachment member, and hence the joining portion of the blade bracket is prevented from being welded to the location connecting the center frame to the connecting member.

Further, the blade bracket is welded to the plate-form attachment member, enabling straight line welding and thus improving weldability.

As a result, the joining strength of the blade bracket to the center frame and connecting member is increased, leading to an improvement in mechanical reliability.

Furthermore, stress generated by a load transmitted from the blade bracket is dispersed upon transmission to the attachment member, and then transmitted to the vehicle body, and hence the load-withstanding strength in relation to operating loads generated by the blade is increased, leading to an improvement in mechanical reliability.

Also, since the joining face of the center frame and the joining face of the connecting member form a single plane, the front plate of the connecting member and the front side plate of the center frame are disposed along the transmission direction of a running load that is transmitted from the connecting member. As a result, running loads are transmitted smoothly from the connecting member to the center frame, thereby contributing to an increase in the load-withstanding strength to running loads and an improvement in mechanical reliability.

Further, the attachment member is planar, and hence easy to manufacture, leading to a reduction in costs.

A construction machine according to an eighth invention comprises a lower traveling body and an upper slewing body which slews freely in relation to the lower traveling body, a frame of the lower traveling body comprising a hollow center frame to which the upper slewing body is slewably attached, a pair of truck frames disposed on an outside of two side portions of the center frame, a hollow connecting member which connects the center frame to the truck frames, and a blade bracket which is joined to the center frame and the connecting member, the construction machine comprising: an attachment member having a plane to which a joining portion of the blade bracket is welded; the center frame having a joining portion at a front thereof to which the attachment member is welded; and the connecting member having a joining portion adjacent to the joining portion of the center frame to which the attachment member is welded, wherein the blade bracket is welded to the center frame and the connecting member via the attachment member.

According to this constitution, the blade bracket is welded to the center frame and connecting member via the attachment member, and hence the joining portion of the blade bracket is prevented from being welded to the location connecting the center frame to the connecting member.

Further, the blade bracket is welded to the face of the attachment member, enabling straight line welding and thus improving weldability.

As a result, the joining strength of the blade bracket to the center frame and connecting member is increased, leading to an improvement in mechanical reliability.

Furthermore, stress generated by a load transmitted from the blade bracket is dispersed upon transmission to the attachment member, and then transmitted to the vehicle body, and hence the load-withstanding strength in relation to operating loads generated by the blade is increased, leading to an improvement in mechanical reliability.

In addition, one face of the attachment member is a face to which the joining portion of the blade bracket is welded, and the other face of the attachment member is a face to which the center frame and connecting member are welded, and hence the attachment member is also applicable to a case in which the joining portion of the center frame and the joining portion of the connecting member are formed with a stepped portion, thus enabling greater design freedom.

DESCRIPTION OF THE PREFERRED EMBODIMENTS

The present invention will be described in detail below on the basis of the drawings illustrating embodiments thereof.

Figure 1:
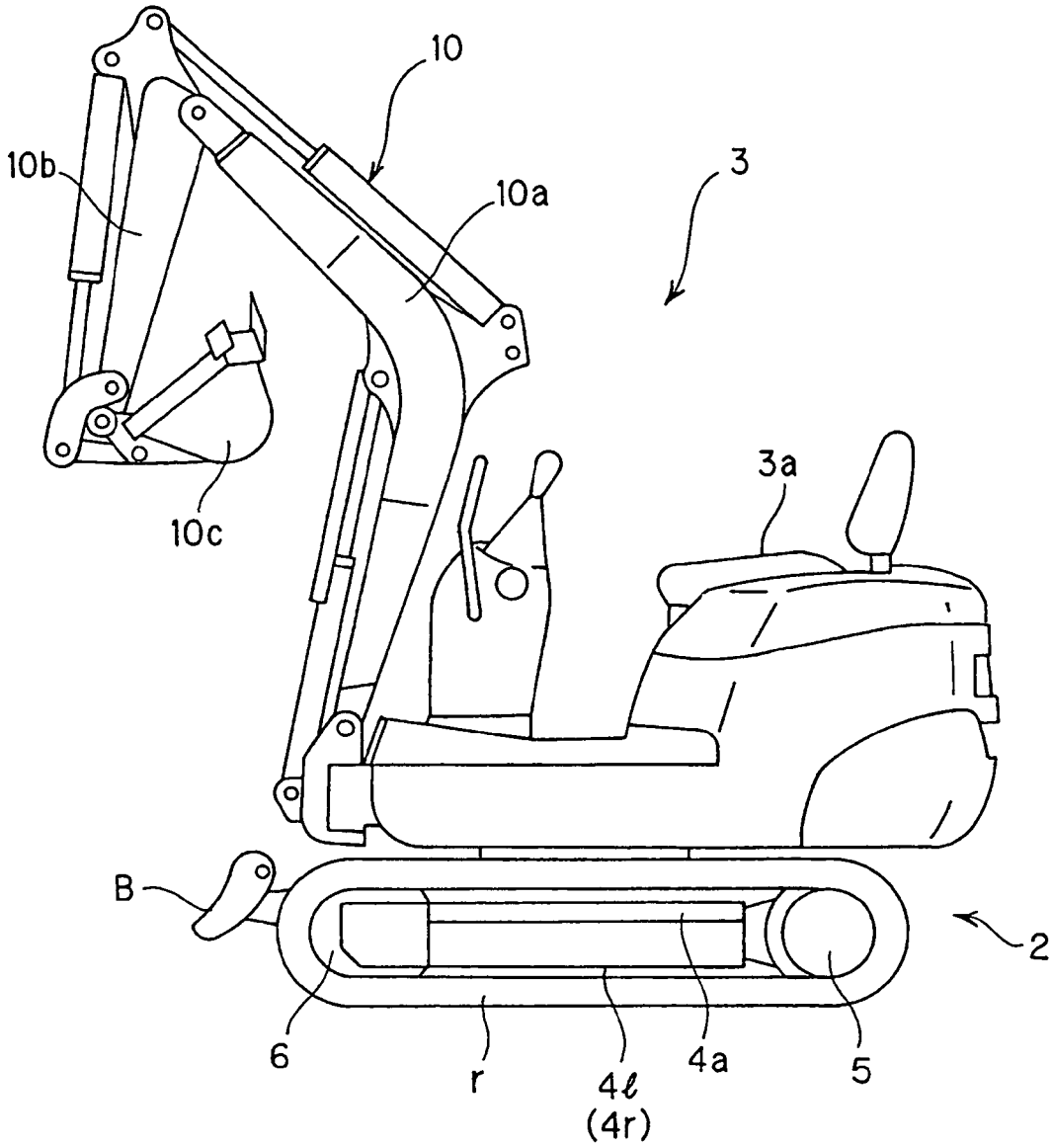
FIG. 1 is a side view showing a hydraulic shovel of an embodiment according to the present invention.

As shown in FIG. 1, a hydraulic shovel 1 according to a first embodiment of the present invention comprises a lower traveling body 2 provided with a crawler belt r to enable motion, and an upper slewing body 3 which is attached slewably to the top of the lower traveling body 2 via a slewing bearing (not shown), and which is mounted by an operator to perform an operation.

An operating seat 3*a* on which the operator sits to perform an operation is provided on the upper slewing body 3, and a working machine 10 comprising a boom 10*a*, an arm 10*b*, and an excavating bucket 10*c* attached to the tip end of the arm 10*b*, which are hydraulically driven, is axially supported in a vertical direction so as to swing freely.

In the lower traveling body 2, a drive shaft 5 and a pivot 6 are attached respectively to the two end portions of truck frames 4*l*, 4*r*, and the crawler belt r is wrapped around the drive shaft 5 and pivot 6.

Further, a blade B used to rebury earth dredged up by the bucket 10*c* is disposed on the front portion of the lower traveling body 2 so as to swing freely about a blade bracket Br (to be described hereinafter), thus enabling the blade B to perform a predetermined operation as an earth-removing plate.

Note that when not in use, the blade B is raised as shown in FIG. 1, and remains so until the beginning of a subsequent operation.

When the blade B is used to rebury dredged up earth in this manner, various loads are applied to the blade bracket Br to which the blade B is attached during an operation.

The hydraulic shovel 1 constituted as described above is driven by a power source engine, the power of which is converted into oil pressure by a hydraulic pump to drive a traction motor. This causes the drive shaft 5 to rotate, which drives the crawler belt r to rotate, and as a result, traveling is performed and various operations using the bucket 10*c* and blade B are performed.

Figure 2:
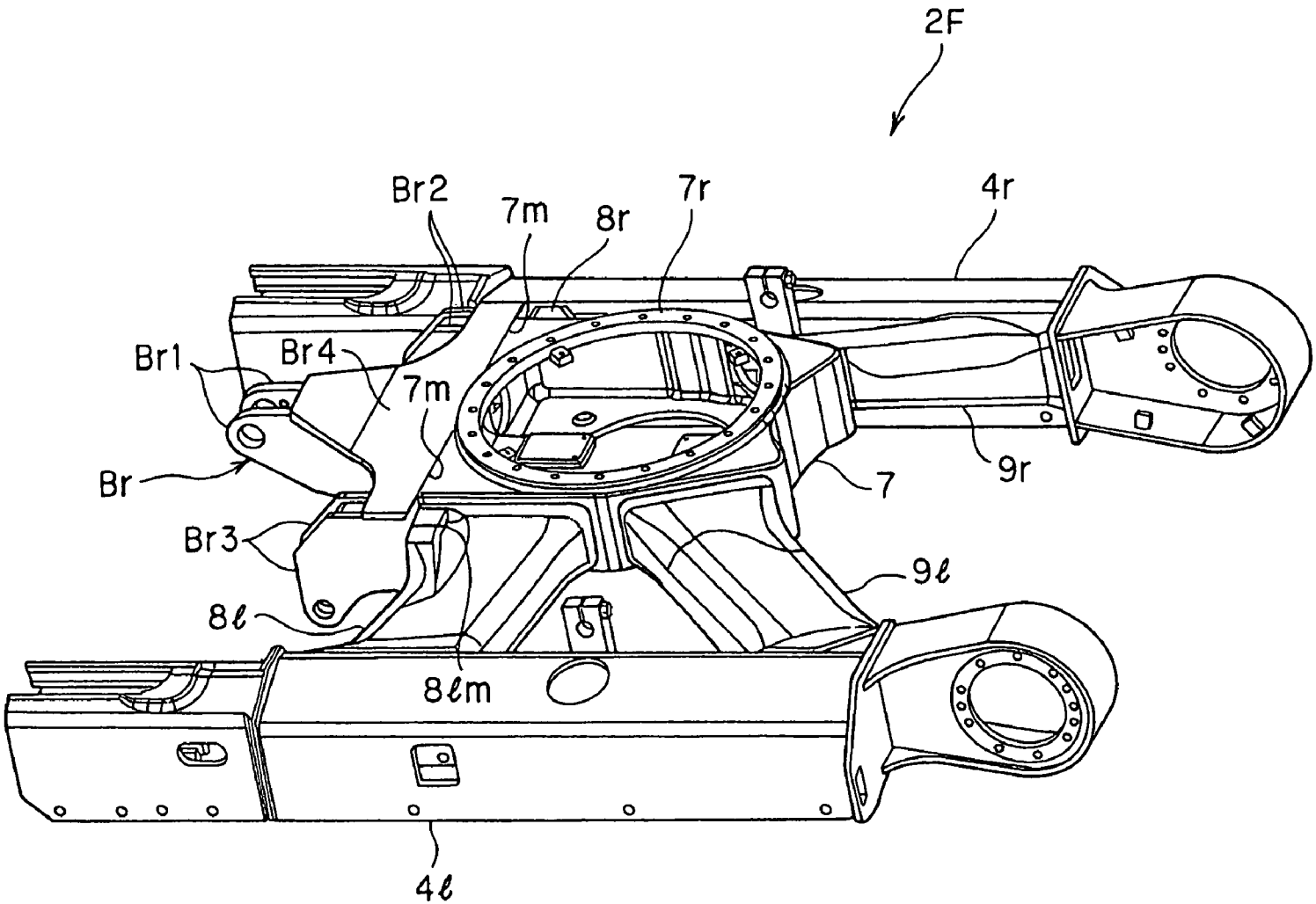
FIG. 2 is a perspective view of a frame of a lower traveling body in the hydraulic shovel of a first embodiment according to the present invention.
Figure 3B:
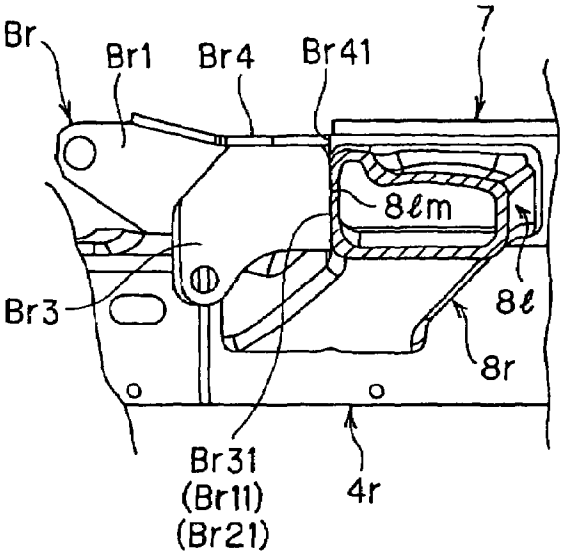
FIGS. 3A and 3B are a top view of the lower traveling body frame in the hydraulic shovel of the first embodiment according to the present invention, and a sectional view along the A-A line in FIG. 3A.
Figure 3A:
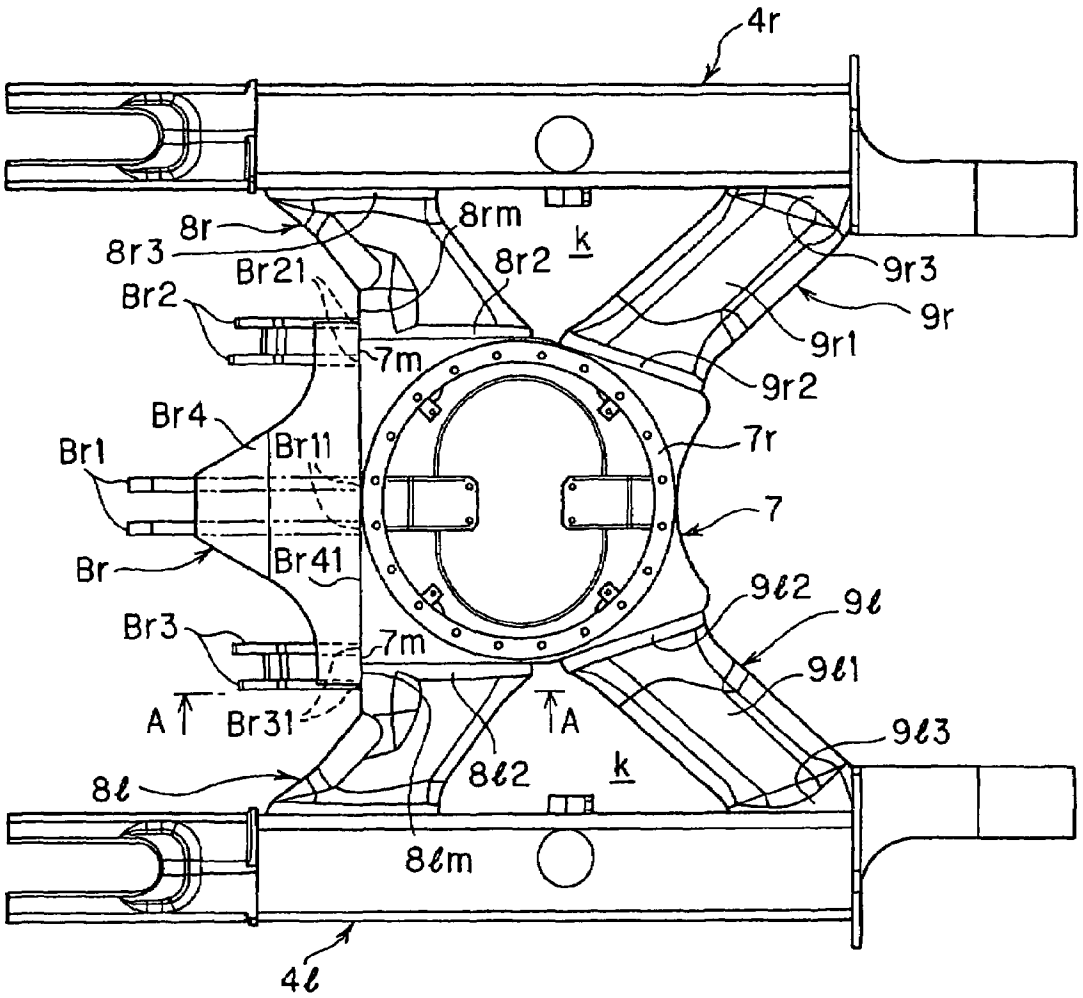

As shown in FIG. 2 and the top view of FIG. 3A, a center frame 7 formed with an attachment ring 7*r* for attaching a slewing bearing is disposed in the central portion of a frame 2F of the lower traveling body, and the truck frames 4*r*, 4*l* are disposed on the two side portions thereof.

The truck frame 4*r* is connected to the center frame 7 by two leg-shaped connecting members 8*r*, 9*r*, and the truck frame 4*l* is connected to the center frame 7 by two leg-shaped connecting members 8*l*, 9*l*.

These members are joined to each other by welding.

The blade bracket Br, to which a hydraulic cylinder for operating the blade B and blade B is attached, is welded to a front face 7*m* of the center frame 7.

Note that as shown in FIG. 3A, the truck frame 4*r* and the pair of connecting members 8*r*, 9*r*, and the truck frame 4*l* and the pair of connecting members 8*l*, 9*l* are constituted in plane symmetry about a central face of the center frame 7 in the direction of width (the central line of the center frame 7 in the vertical direction of FIG. 3A).

More specifically, the connecting member 8*r* and connecting member 8*l* take a symmetrical form about the central face of the center frame 7 in the direction of width, and the connecting member 9*r* and connecting member 9*l* take a symmetrical form about the central face of the center frame 7 in the direction of width.

As shown in FIGS. 2, 3, the blade bracket Br comprises a central pair of cylinder fulcrum plates Br1 which rotatably support a hydraulic cylinder for operating the bracket Br, a pair of right blade fulcrum plates Br2 and a pair of left blade fulcrum plates Br3 on the two side portions for rotatably supporting the blade B, and a reinforcing plate Br4 which is joined to the upper face of the cylinder fulcrum plates Br1, the upper face of the right blade fulcrum plates Br2, and the upper face of the left blade fulcrum plates Br3.

These plates are welded to each other to form a subassembly as the blade bracket Br, and then welded to the front face 7*m* of the center frame 7.

In the blade bracket Br, rear faces Br11 of the cylinder fulcrum plates Br1, rear faces Br21 of the right blade fulcrum plates Br2, rear faces Br31 of the left blade fulcrum plates Br3, and a rear face Br41 of the reinforcing plate Br4 are formed into a vertical plane which constitutes a joining portion that is welded to the front face 7*m* of the center frame 7.

Note that as long as the rear faces Br11 of the cylinder fulcrum plates Br1, the rear faces Br21 of the right blade fulcrum plates Br2, the rear faces Br31 of the left blade fulcrum plates Br3, and the rear face Br41 of the reinforcing plate Br4 are formed into a single plane, this plane is not strictly limited to a vertical plane.

Figure 4B:
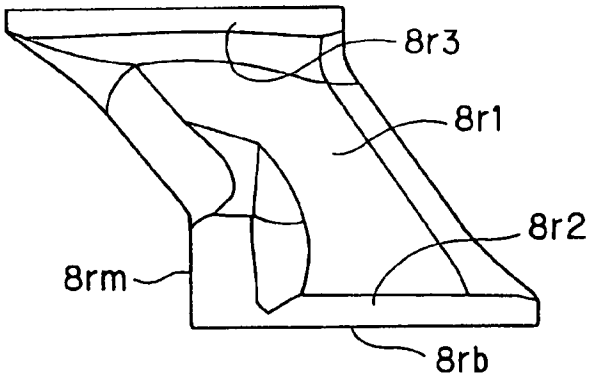
FIGS. 4A, 4B, and 4C are a perspective view showing a center frame of the hydraulic shovel of the first embodiment according to the present invention, a top view of a connecting member 8*r*, and a view showing the connecting member 8*r* seen from the center frame in the lower traveling body frame shown in FIG. 3A.
Figure 4C:
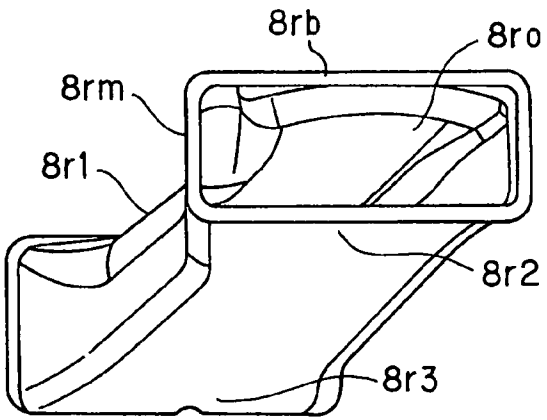
Figure 4A:
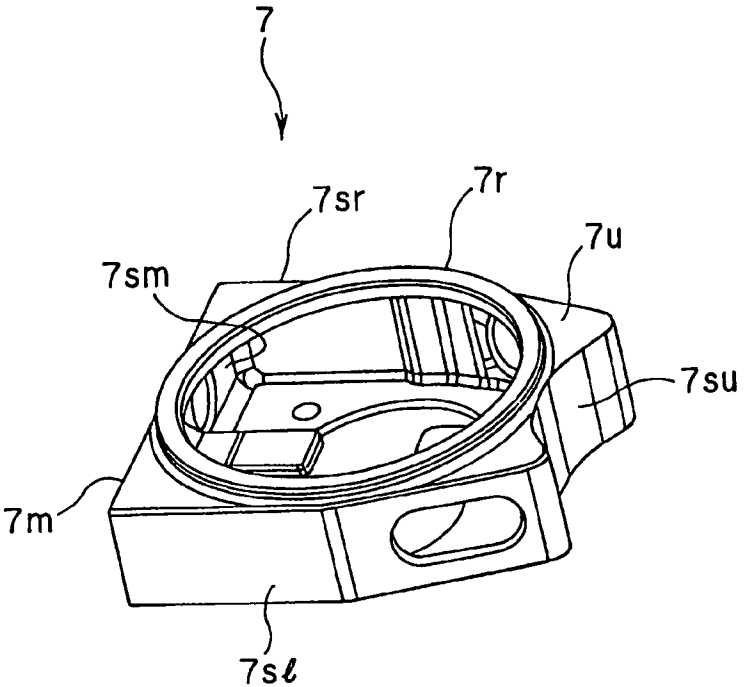

The center frame 7 is manufactured as a cast using cast steel, and as shown in FIG. 4A, is constituted in a hollow box form having a front side plate Ism, a rear side plate 7*su*, a right side plate 7*sr* to which the connecting members 8*r*, 9*r* are joined, a left side plate 7*s*1 to which the connecting members 8*l*, 9*l* are joined, an upper plate 7*u* in which the attachment ring 7*r* having an opening is formed, and so on.

The front face 7*m* in the center frame 7 forms a vertical plane which corresponds to the rear faces Br11 of the cylinder fulcrum plates Br1, the rear faces Br21 of the right blade fulcrum plates Br2, the rear faces Br 31 of the left blade fulcrum plates Br3, and the rear face Br41 of the reinforcing plate Br4, which serve as the joining portion of the blade bracket Br (see FIGS. 2, 3).

By constituting the rear faces Br11 of the cylinder fulcrum plates Br1, the rear faces Br21 of the right blade fulcrum plates Br2, the rear faces Br31 of the left blade fulcrum plates Br3, and the rear face Br41 of the reinforcing plate Br4 serving as the joining portion of the blade bracket Br, and the front face 7*m* of the center frame 7 serving as the face to which the joining portion of the blade bracket Br is joined, as a vertical plane in this manner, the form of the blade bracket Br and center frame 7 is simplified, and straight line welding can be performed when the blade bracket Br is welded to the center frame 7.

In addition, operations in the design and assembly processes are simplified, which is of course advantageous.

Note that as long as the front face 7*m* of the center frame 7, which is the face to which the blade bracket Br is joined, has a planar form which matches the joining portion of the blade bracket Br, then the face is not strictly limited to a vertical plane.

The connecting member 8*r* is manufactured as a cast using cast steel, and as shown in the top view in FIG. 4B and FIG. 4C (which is a perspective view of the connecting member 8*r* alone seen from the side of the center frame 7 shown in FIG. 3A), is constituted in a hollow form comprising a core portion 8*r*1 having a substantially pentagonal cross section and provided with an angled portion at the upper portion thereof at which a ridge is formed in the longitudinal direction of the upper face, a center joining portion 8*r*2 having a quadrilateral cross section and formed with an opening 8*r*0, and a truck joining portion 8*r*3 formed with an opening.

The center joining portion 8*r*2 of the connecting member 8*r* comprises a joining face 8*rb* which is joined to the right side plate 7*sr* of the center frame 7, and as shown in FIG. 3, this joining face 8*rb* is formed in planar form to form a straight line when seen from above, and is thus non-perpendicular to the axis which runs along the direction in which the connecting member 8*r* extends.

Further, the height dimension between the upper and lower faces of the center joining portion 8*r*2 having the joining face 8*rb* is set to be slightly shorter than the dimension between the upper and lower faces of the center frame 7 (see FIG. 2).

A joining face 8*rm* which serves as a joining portion with the blade bracket Br is formed on a part of the front face of the connecting member 8*r* as a vertical plane corresponding to the rear faces Br21 of the right blade fulcrum plates Br2 and the rear face Br41 of the reinforcing plate Br4 which serve as the joining portion of the blade bracket Br (see FIGS. 3, 4).

Here, when the connecting member 8*r* is joined to the center frame 7 such that the central welding portion 8*r*2 of the connecting member 8*r* is welded to the right side plate 7*sr* of the center frame 7, the joining face 8*rm* of the connecting member 8*r* is adjacent to the front face 7*m* of the center frame 7 as shown in FIG. 3, and thus forms a single plane together with the front face 7*m* of the center frame 7.

The connecting member 8*l* shown in FIGS. 2, 3 is manufactured as a cast using cast steel, and as described above, is constituted in plane symmetry with the connecting member 8*r* about the central face of the center frame 7 in the direction of width.

In other words, similarly to the connecting member 8*r*, the connecting member 81 is formed as a hollow pipe-form member extending in a longitudinal direction having a closed transverse cross section, and thus takes a similar form to the connecting member 8*r*.

A joining face 81*m* which serves as a joining portion with the blade bracket Br is formed on a part of the front face of the connecting member 8*l* as a vertical plane corresponding to the rear faces Br31 of the left blade fulcrum plates Br3 and the rear face Br41 of the reinforcing plate Br4 which serve as the joining portion of the blade bracket Br.

Here, when the connecting member 8*l* is joined to the center frame 7 such that a central welding portion 812 of the connecting member 8*l* is welded to the right side plate 7*s*1 of the center frame 7, the joining face 81*m* of the connecting member 8*l* is adjacent to the front face 7*m* of the center frame 7, and thus forms a single plane together with the front face 7*m* of the center frame 7.

Note that as long as the joining faces 8*rm*, 8*lm* on the connecting members 8*r*, 8*l* which serve as faces to which the blade bracket Br is joined have a planar form which matches that of the joining portion of the blade bracket Br, then the faces are not strictly limited to vertical planes.

As shown in FIGS. 2, 3, the connecting member 9*r* is manufactured as a cast using cast steel, and is constituted in a hollow form comprising a tapered core portion 9*r*1 having a substantially pentagonal cross section and provided with an angled portion at the upper portion thereof on which a ridge is formed in the longitudinal direction of the upper face, a center joining portion 9*r*2 having a quadrilateral cross section and formed with an opening, and a truck joining portion 9*r*3 formed with an opening.

Likewise, the connecting member 9*l* is manufactured as a cast using cast steel, and as described above, is constituted in plane symmetry with the connecting member 9*r* about the central face of the center frame 7 in the direction of width.

As described above, the connecting members 8*r*, 8*l*, 9*r*, 9*l* are formed with an angled ridge on the upper face thereof, and hence earth or the like that is churned up by the crawler belt r during traveling slides down the inclined upper surface of the connecting members 8*r*, 8*l*, 9*r*, 9*l* and falls onto the ground. Thus earth or the like is prevented from accumulating on the connecting members 8*r*, 8*l*, 9*r*, 9*l*.

Further, spaces k, k are formed between the connecting members 8*r*, 9*r* and the connecting members 8*l*, 9*l* respectively, and hence earth or the like churned up by the crawler belts r, r passes through the spaces k, k and falls onto the ground. Thus earth removal is precipitated favorably.

Next, a method of joining the blade bracket Br to the center frame 7 and connecting members 8*r*, 9*r* will be described.

First, the connecting member 8*r* is disposed in a central portion in the direction of height in relation to the right side plate 7*sr* of the center frame 7, and in a position at which the front face 7*m* of the center frame 7 and the joining face 8*rm* of the connecting member 8*r* form a single plane, as shown in FIG. 3, whereupon an outer edge portion of the center joining portion 8*r*2 of the connecting member 8*r* is welded to the right side plate 7*sr* of the center frame 7 such that the center frame 7 and connecting member 8*r* are connected.

Similarly, the connecting member 8*l* is disposed in a central portion in the direction of height in relation to the left side plate 7*s*1 of the center frame 7, and in a position at which the front face 7*m* of the center frame 7 and the joining face 8*lm* of the connecting member 8*l* form a single plane, as shown in FIG. 3, whereupon an outer edge portion of the center joining portion 812 of the connecting member 8*l* is welded to the left side plate 7*s*1 of the center frame 7 such that the center frame 7 and connecting member 8*l* are connected.

By having the joining face 8*rm* of the connecting member 8*r* form a single plane with the front face 7*m* of the center frame 7, and the joining face 8*lm* of the connecting member 8*l* form a single plane with the front face 7*m* of the center frame 7 in this manner, the center frame 7 and the connecting members 8*r*, 8*l* are assembled integrally.

Next, the rear faces Br21 of the right blade fulcrum plates Br2 and a part of the rear face Br41 of the reinforcing plate Br4 on the blade bracket Br are aligned with and caused to contact the front face 7*m* of the center frame 7 and the joining face 8*rm* of the connecting member 8*r* which form a single plane, and the rear faces Br31 of the left blade fulcrum plates Br3 and a part of the rear face Br41 of the reinforcing plate Br4 on the blade bracket Br are aligned with and caused to contact the front face 7*m* of the center frame 7 and the joining face 8*lm* of the connecting member 8*l* which form a single plane, and are thus disposed in a predetermined position.

Next, the rear faces Br21 of the right blade fulcrum plates Br2 are welded to the front face 7*m* of the center frame 7 and the joining face 8*rm* of the connecting member 8*r*, the rear face Br41 of the reinforcing plate Br4 is welded to the front face 7*m* of the center frame 7, the joining face 8*rm* of the connecting member 8*r*, and the joining face 8*lm* of the connecting member 8*l*, and the rear faces Br31 of the left blade fulcrum plates Br3 are welded to the front face 7*m* of the center frame 7 and the joining face 8*lm* of the connecting member 8*l*.

Simultaneously, the rear faces Br11 of the cylinder fulcrum plates Br1 are welded to the front face 7*m* of the center frame 7, and thus the blade bracket Br is joined to the front face 7*m* of the center frame 7.

According to this constitution, the rear faces Br21 of the right blade fulcrum plates Br2 and the rear face Br41 of the reinforcing plate Br4, which serve as the joining portion of the blade bracket Br, form a single plane with the welded front face 7*m* of the center frame 7 and the joining face 8*rm* of the connecting member 8*r* to which the rear faces Br21, Br41 are welded.

Further, the rear faces Br31 of the left blade fulcrum plates Br3 and the rear face Br41 of the reinforcing plate Br4, which serve as the joining portion of the blade bracket Br, form a single plane with the welded front face 7*m* of the center frame 7 and the joining face 8*lm* of the connecting member 8*l* to which the rear faces Br31, Br41 are welded.

Thus straight line welding is possible when welding the blade bracket Br to the center frame 7 and connecting members 8*r*, 8*l*, making the welding operation easy.

Further, since the blade bracket Br is welded securely to the center frame 7 and connecting members 8*r*, 8*l*, the joining strength is improved, leading to an improvement in mechanical reliability.

Moreover, load stress on the blade bracket Br caused by an operation of the blade B is dispersed over the joining locations of the center frame 7 and connecting members 8*r*, 8*l* which form a single plane, and hence stress concentration does not occur at the planar joining surface, and load stress is dispersed smoothly.

Thus the load-withstanding strength of the blade B increases, leading to an improvement in mechanical reliability.

Further, the respective joining locations of the center frame 7 and connecting members 8*r*, 8*l* to which the blade bracket Br is welded form a single plane, and hence a joining portion for the blade bracket Br which forms a single plane can be used, leading to simplification of the form of the blade bracket Br and a reduction in manufacturing costs.

Also, since the joining locations of the center frame 7 and the connecting members 8*r*, 8*l* to which the blade bracket Br is welded form a single plane, a blade bracket with the same dimensions can be used with either a narrow center frame or a wide center frame, and thus a standardized blade bracket having predetermined dimensions can be used regardless of the size of the machine.

As a result, the manufacturing costs of the hydraulic shovel can be reduced.

Furthermore, since a wide blade bracket Br can be used, the dimension between the right blade fulcrum plates Br2 and the left blade fulcrum plates Br3, the dimension between the cylinder fulcrum plates Br1 and the right blade fulcrum plates Br2, and the dimension between the cylinder fulcrum plates Br1 and the left blade fulcrum plates Br3 of the blade bracket Br can each be widened.

As a result, operating loads generated by the blade B can be received by the wide blade bracket Br such that the length of the moment lever of the operating load increases, causing the load generated by the moment of the operating load to decrease, and the moment load which acts on the cylinder fulcrum plates Br1, right blade fulcrum plates Br2, and left blade fulcrum plates Br3 to decrease.

Hence an operating load generated by the blade B that is transmitted to the blade bracket Br decreases, which is effective in preventing wear to the vehicle body and improving the operating performance of the blade B.

Note that in the embodiment described above, an example was described in which the front face 7*m* of the center frame 7 forms a plane, but as long as at least the joining locations of the blade bracket Br form a single plane, the entire front face of the center frame 7 need not be formed as a plane.

Also in the embodiment described above, an example was described in which the blade bracket Br is joined to the center frame 7 and connecting members 8*r*, 8*l* by welding, but bolts may be used for this purpose instead of welding.

In a small hydraulic shovel, depending on the constitution thereof, a location at which the center frame 7 and connecting member 8*r* are fillet welded may overlap the outer edge portions of the rear faces Br21 of the right blade fulcrum plates Br2, which serve as welding locations for welding the blade bracket Br to the center frame 7 and so on, and likewise, a location at which the center frame 7 is fillet welded to the connecting member 8*l* may overlap the outer edge portions of the rear faces Br31 of the left blade fulcrum plates Br3, which serve as welding locations for welding the blade bracket Br to the center frame 7 and so on.

In other words, the welding location of the center frame 7 and the connecting members 8*r*, 8*l* may match the welding location of the blade bracket Br.

In such a case, three members are fillet welded in a single location, leading to problems such as defects in the welding work and a lack of reliability in the welding strength.

These problems are solved in the second embodiment to be described below.

Figure 5:
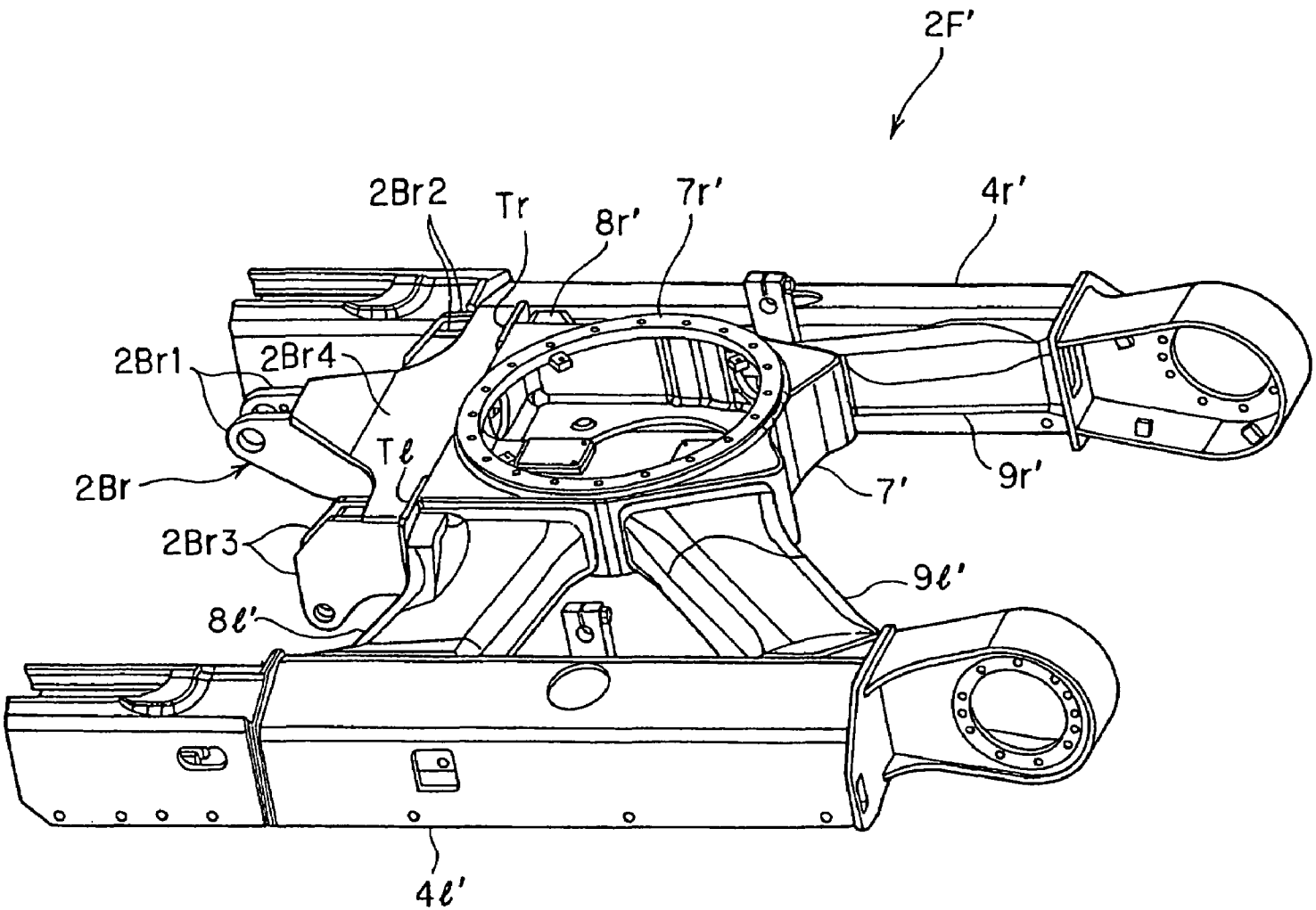
FIG. 5 is a perspective view of a frame of a lower traveling body in a hydraulic shovel of a second embodiment according to the present invention.

As shown in FIG. 5, in the second embodiment, a blade bracket 2Br is joined to a center frame 7' and connecting members 8*r'*, 8*l'* via attachment plates Tr, Tl.

Apart from this point, the constitution of the second embodiment is identical to that of the first embodiment. Hence identical constitutional elements are illustrated by adding ' to the same reference symbol, and detailed description of these elements is omitted.

Figure 6B:
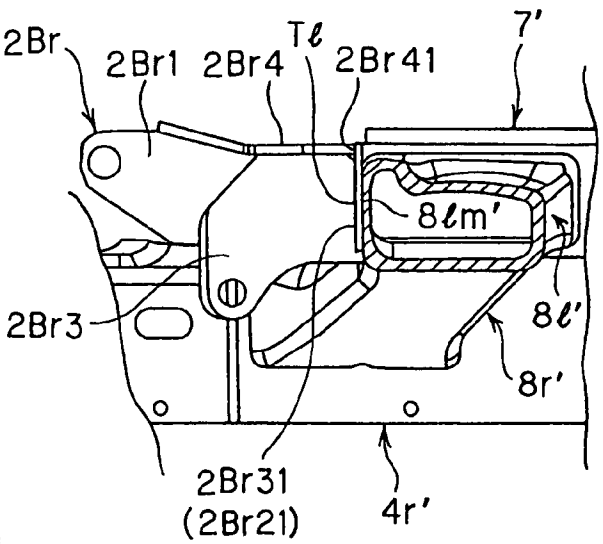
FIGS. 6A and 6B are a top view of the lower traveling body frame in the hydraulic shovel of the second embodiment according to the present invention, and a sectional view along the B-B line in FIG. 6A.

As shown in FIGS. 5, 6, the blade bracket 2Br to which a blade B' and a hydraulic cylinder (not shown) for operating the blade B' are attached is welded to the front of the center frame 7' and connecting members 8*r'* and 8*l'* via the plate form attachment plates Tr, Ti serving as attachment members.

As shown in FIGS. 5, 6, the blade bracket 2Br comprises a central pair of cylinder fulcrum plates 2Br1 which rotatably support the hydraulic cylinder for operating the blade B', a pair of right blade fulcrum plates 2Br2 and a pair of left blade fulcrum plates 2Br3 on the two side portions for rotatably supporting the blade B', and a reinforcing plate 2Br4 which is joined to the upper face of the cylinder fulcrum plates 2Br1, the upper face of the right blade fulcrum plates 2Br2, and the upper face of the left blade fulcrum plates 2Br3.

Here, notch portions 2Br41, 2Br41 are formed as joining portions on the rear face 2Br42 of the reinforcing plate 2Br4 of the blade bracket 2Br to enable joining to the respective attachment plates Tr, Tl, a notch portion 2Br21 is formed as a joining portion on the rear faces 2Br2 of the right blade fulcrum plates 2Br2 to enable joining to the attachment plate Tr, and a notch portion 2Br31 is formed as a joining portion on the rear faces 2Br3 of the left blade fulcrum plates 2Br3 to enable joining to the attachment plate Tl.

Note that the attachment plates Tr, Tl are steel plates of a predetermined size and thickness.

The blade bracket 2Br and attachment plates Tr, Tl constituted as described above are sub-assembled integrally by joining the cylinder fulcrum plates 2Br1, right blade fulcrum plates 2Br2, left fulcrum plates 2Br3, and reinforcing plate 2Br4 together by welding, welding the attachment plate Tr to the notch portion 2Br41 of the reinforcing plate 2Br4 and the notch portion 2Br21 of the right blade fulcrum plates 2Br2, and welding the attachment plate Tl to the notch portion 2Br41 of the reinforcing plate 2Br4 and the notch portion 2Br31 of the left blade fulcrum plates 2Br3.

In this subassembly, the rear face of the attachment plate Tr is formed as a vertical plane serving as a joining location to which the front face 7*m'* of the center frame 7' and the joining face 8*rm'* of the connecting member 8*r'* are welded, and the rear face of the attachment plate Tl is formed as a vertical plane serving as a joining location to which the front face 7*m'* of the center frame 7' and the joining face 81*m'* of the connecting member 8*l'* are welded.

Note that as long as the rear faces of the attachment plates Tr, Tl of the subassembly described above are formed as a single plane, this plane is not strictly limited to a vertical plane.

Also, as long as the front face 7*m'* serving as the joined face of the center frame 7' aligns with the rear faces of the attachment plates Tr, Tl of the subassembly comprising the blade bracket and so on, this face is not strictly limited to a vertical plane.

In other words, when the rear faces of the attachment plates Tr, Tl of the subassembly are formed as a plane other than a vertical plane, the front face 7*m'* of the center frame 7' should be formed as a plane other than a vertical plane which aligns with the plane of the rear faces.

Further, the joining face 8*rm'* serving as a joining portion for the blade bracket Br' on a part of the front face of the connecting member 8*r'* is formed as a vertical plane corresponding to the rear face of the attachment plate Tr of the subassembly comprising the blade bracket and so on (see FIG. 6).

Here, when the connecting member 8*r'* is joined to the center frame 7' such that the central welding portion 8*r*2' of the connecting member 8*r'* is welded to the right side plate 7*sr'* of the center frame 7', the joining face 8*rm'* of the connecting member 8*r'* is adjacent to the front face 7*m'* of the center frame 7' as shown in FIG. 6, and thus forms a single plane together with the front face 7*m'* of the center frame 7'.

The joining face 8*lm*', which serves as a joining portion for the rear face of the attachment plate Tl of the subassembly comprising the blade bracket and so on, is formed on a part of the front face of the connecting member 8*l*' as a vertical plane corresponding to this rear face.

Here, when the connecting member 8*l*' is joined to the center frame 7' such that the central welding portion 812' of the connecting member 8*l*' is welded to the left side plate 7*s*1' of the center frame 7', the joining face 8*lm*' of the connecting member 8*l*' is adjacent to the front face 7*m*' of the center frame 7', and thus forms a single plane together with the front face 7*m*' of the center frame 7'.

Note that as long as the joining faces 8*rm*', 8*lm*' of the connecting members 8*r*', 8*l*', which serve as faces to which the blade bracket 2Br is joined, form a plane which matches the rear faces of the attachment plates Tr, Tl of the subassembly comprising the blade bracket and so on, these faces are not strictly limited to a vertical plane.

Next, a method of joining the blade bracket 2Br to the center frame 7' and connecting members 8*r*', 8*l*' will be described.

The rear faces of the attachment plates Tr, Tl of the subassembly comprising the blade bracket 2Br and so on are aligned with and caused to contact the front face 7*m*' of the center frame 7' and the joining face 8*rm*' of the connecting member 8*r*', and the front face 7*m*' of the center frame 7' and the joining face 8*lm*' of the connecting member 8*l*', which respectively form single planes, and thus disposed in a predetermined position.

Next, the rear face of the attachment plate Tr in the subassembly comprising the blade bracket 2Br and so on is welded to the front face 7*m*' of the center frame 7' and the joining face 8*rm*' of the connecting member 8*r*', and the rear face of the attachment plate Tl in the subassembly comprising the blade bracket 2Br and so on is welded to the front face 7*m*' of the center frame 7' and the joining face 8*lm*' of the connecting member 8*l*'.

Simultaneously, the rear face 2Br42 of the reinforcing plate 2Br4 and the rear faces 2Br11 of the cylinder fulcrum plates 2Br1 in the subassembly comprising the blade bracket 2Br and so on are welded to the front face 7*m*' of the center frame 7'.

According to this constitution, the right blade fulcrum plates 2Br2 on the blade bracket 2Br are welded to the attachment plate Tr, the left blade fulcrum plates 2Br3 are welded to the attachment plate Tl, and thus a subassembly comprising the blade bracket 2Br and the attachment plates Tr, Tl is manufactured.

By welding the attachment plate Tr of the subassembly to the center frame 7' and connecting member 8*r*', and welding the attachment plate Tl to the center frame 7' and connecting member 8*l*', the blade bracket 2Br is joined to the center frame 7' and connecting members 8*r*', 8*l*' via the attachment plates Tr, Tl.

Hence the attachment plate Tr is interposed between the welding location of the center frame 7' and connecting member 8*r*' and the right blade fulcrum plates 2Br2 of the blade bracket 2Br, and thus the welding location between the center frame 7' and connecting member 8*r*' and the welding locations of the right blade fulcrum plates 2Br2 are prevented from overlapping directly.

Similarly, the attachment plate Tl is interposed between the welding location of the center frame 7' and connecting member 8*l*' and the left blade fulcrum plates 2Br3 of the blade bracket 2Br, and thus the welding location between the center frame 7' and connecting member 8*l*' and the welding locations of the right blade fulcrum plates 2Br3 are prevented from overlapping directly.

Thus when the blade bracket 2Br is welded to the center frame 7' and connecting members 8*r*', 8*l*', overlapping welding between the right blade fulcrum plates 2Br2 on the blade bracket 2Br and the welding location of the center frame 7' and connecting member 8*r*' can be prevented, and overlapping welding between the left blade fulcrum plates 2Br3 and the welding location of the center frame 7' and connecting member 8*l*' can also be prevented.

Further, the right blade fulcrum plates 2Br2 of the blade bracket 2Br are welded to the plate-form attachment plate Tr, and hence straight line welding is possible.

Likewise, the left blade fulcrum plates 2Br3 of the blade bracket 2Br are welded to the plate-form attachment plate Tl, and hence straight line welding is possible.

Straight line welding may also be employed to join the attachment plates Tr, Tl to the center frame 7' and connecting members 8*r*', 8*l*' respectively.

Hence the weldability of the blade fulcrum plates 2Br2, 2Br3 on the blade bracket 2Br is improved, and the weldability and joining strength of the attachment plates Tr, Tl are increased, leading to an improvement in mechanical reliability.

Furthermore, the blade bracket 2Br is connected to the center frame 7' and connecting members 8*r*, 8*l*' via the attachment plates Tr, Tl, and hence operating load stress transmitted to the blade bracket 2Br from the blade B' is dispersed upon transmission to the attachment plates Tr, Tl, enabling smooth transmission thereof to the vehicle body.

As a result, the load-withstanding strength in relation to operating loads from the blade B' is heightened, leading to an improvement in reliability, the prevention of wear to the vehicle body, and extended longevity.

Figure 6A:
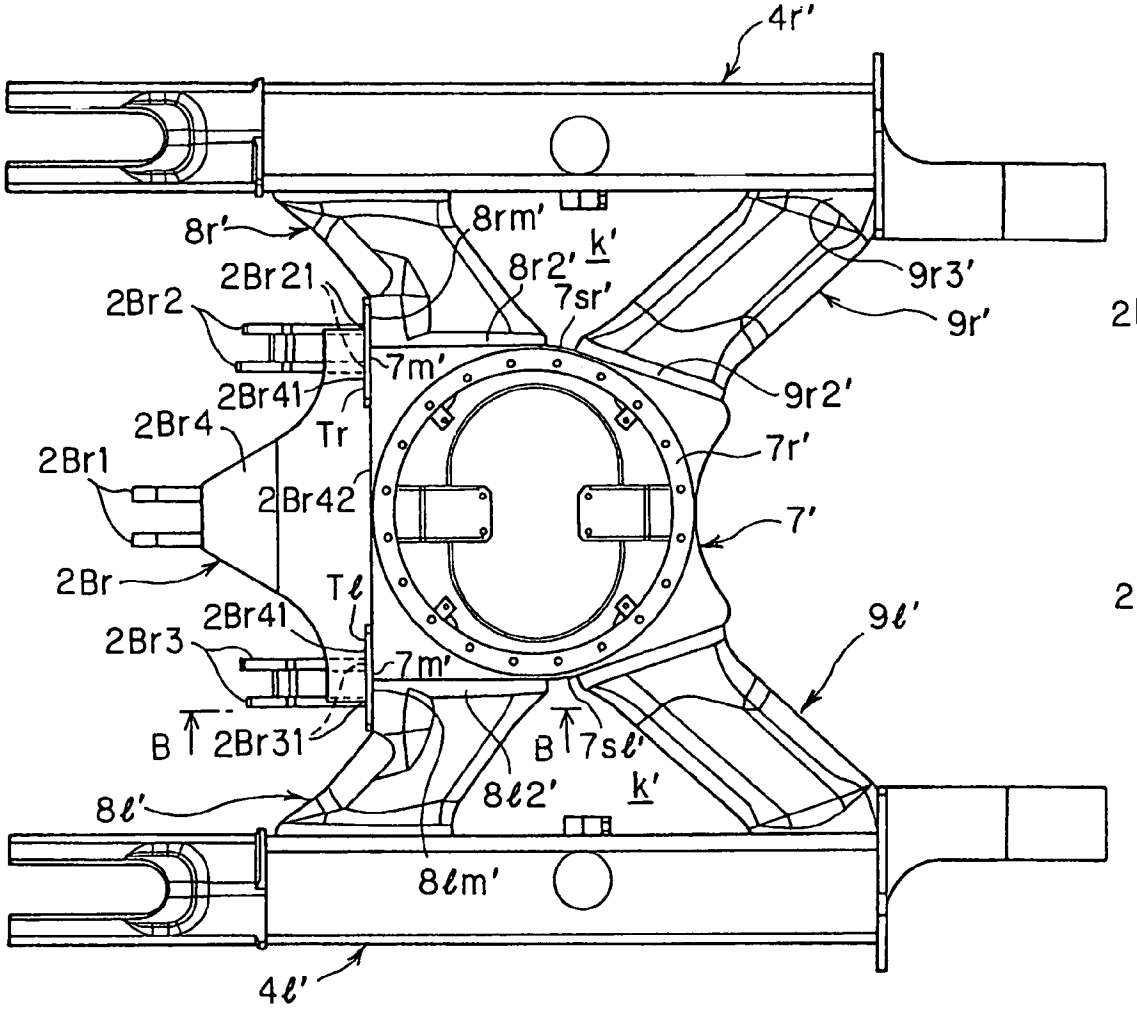

In addition, as shown in FIG. 6A, the front face 7*m*' of the center frame 7' and the joining faces 8*rm*', 8*lm*' of the connecting members 8*r*, 8*l*' form a single plane, and hence loads caused by the traveling of the crawler belt $r^{ri}$, which are transmitted from the connecting members 8*r*, 8*l*' to the center frame 7', are transmitted from the front face plate of the connecting members 8*r*, 8*l*', disposed in a position along the load transmission direction, to the front side plate 7*sm*' of the center frame 7'. Thus running loads from the connecting members 8*r*, 8*l*' are transmitted smoothly to the center frame 7'.

As a result, the load-withstanding strength in relation to operating loads is heightened, leading to an improvement in mechanical reliability.

Further, since the attachment plates Tr, Tl are constituted by plate-form steel plates, manufacture is easy and costs are low.

Similarly to the first embodiment, a wide blade bracket 2Br can be used, and hence the length of the moment lever of an operating load from the blade B' increases, causing the load generated by the moment of the operating load to decrease, and the moment load acting on the cylinder fulcrum plates 2Br1, right blade fulcrum plates 2Br2, and left blade fulcrum plates 2Br3 to decrease.

Hence an operating load generated by the blade B' that is transmitted to the vehicle body via the blade bracket 2Br decreases, which is effective in preventing wear to the vehicle body and improving the operating performance of the blade B'.

Note that in the embodiment described above, an example was described in which attachment members for attaching the blade bracket 2Br to the center frame 7' and connecting members 8*r*', 8*l*' are constituted by the plate-form attachment plates Tr, Tl, but the attachment members do not necessarily have to be plate-form.

For example, the joining faces of the connecting members may be disposed behind the front face of the center frame and provided with a stepped portion such that the attachment members comprise a face which runs along the stepped portion between the front face of the center frame and the joining faces of the connecting members, and a face to which the joining portion of the blade bracket 2Br is welded.

Likewise in this constitution, the attachment members are interposed between the blade bracket 2Br and the center frame and connecting members, and hence the blade bracket 2Br is welded to the center frame and connecting members via the attachment members. As a result, the welding location of the blade bracket 2Br does not overlap the welding location between the center frame and connecting members. Further, the joining portion of the blade bracket 2Br is welded to the face of the attachment members, enabling straight line welding and thus improving weldability.

As a result, the joining strength of the blade bracket 2Br to the center frame and connecting members is increased, leading to an improvement in mechanical reliability.

Moreover, operating load stress transmitted to the blade bracket 2Br from the blade B' is dispersed upon transmission to the attachment members, enabling smooth transmission thereof to the vehicle body via the attachment members. As a result, the mechanical reliability is improved.

Thus similar effects to those of the embodiment described above are achieved.

In addition, one face of the attachment members is a plane to which the joining portion of the blade bracket 2Br is welded, and the other face of the attachment members is a face to which the center frame and connecting members are welded, and hence the attachment members are also applicable to a case in which the joining portion of the center frame and the joining portions of the connecting members are formed with an arbitrary stepped portion, thus enabling greater design freedom.

Note that in the embodiment described above, a case was described in which the blade bracket 2Br is joined to the center frame 7' and connecting members 8*r*', 8*l*' by being welded via attachment members such as the attachment plates Tr, Tl, but joining may be performed using bolts instead of welding.

Next, modified examples of the first and second embodiments will be described using FIGS. 7, 8.

FIG. 7 shows top views of various modified examples of the first embodiment in which blade brackets 3Br, 4Br, 5Br are joined respectively to the front face 7*m*' of the center frame 7' and the joining faces 8*rm*', 8*r*1' of the connecting members se, 8*l*' without the interposition of attachment members.

Figure 7C:
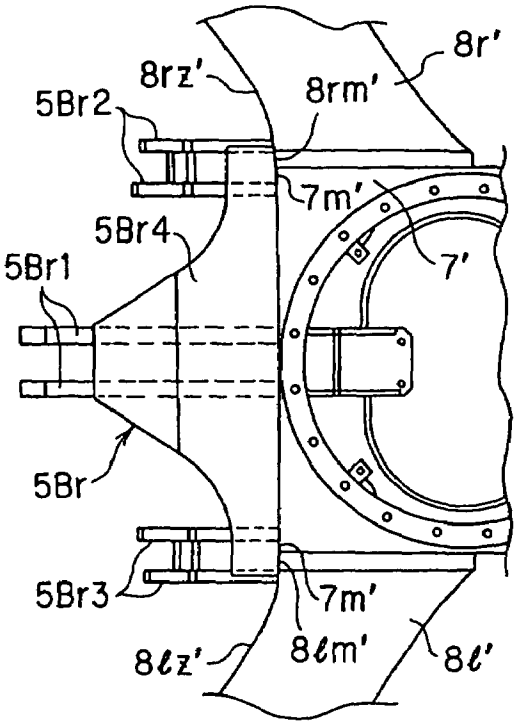
FIGS. 7A, 7B, and 7C are a top view showing a first modified example of the joining condition between the center frame, the connecting member, and a blade bracket in the hydraulic shovel of the first embodiment according to the present invention, a top view showing a second modified example thereof, and a top view showing a third modified example thereof.
Figure 7B:
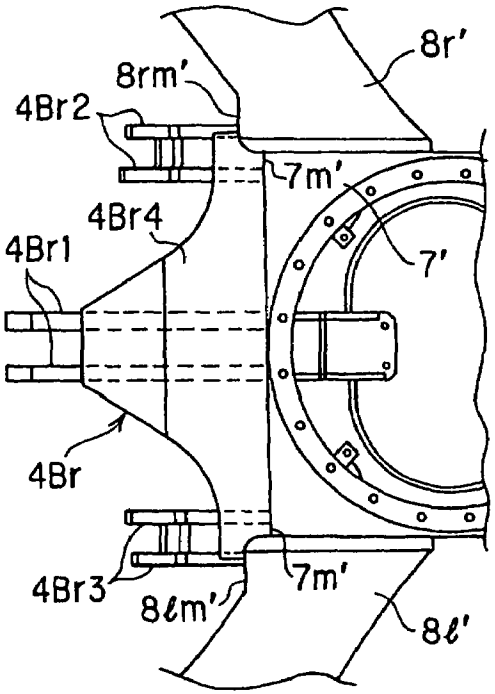
Figure 7A:
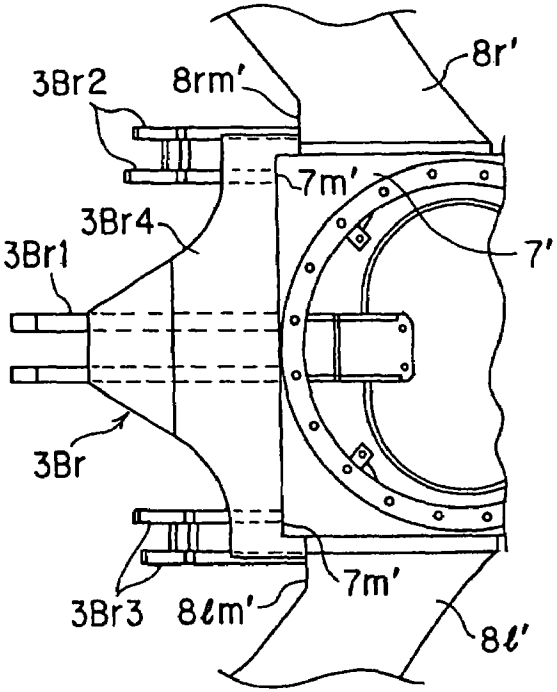

FIG. 7A shows a first modified example in which the joining faces 8*rm*', 8*lm*' serving as the joining portions of the connecting members 8*e*, 8*l*' with the blade bracket 3Br are positioned rearward of the front face 7*m*' of the center frame 7'.

In this case, cylinder fulcrum plates 3Br1, right blade fulcrum plates 3Br2, left blade fulcrum plates 3Br3, and a reinforcing plate 3Br4 of the blade bracket 3Br are formed in alignment with the stepped portion between the front face 7*m*' of the center frame 7' and the joining face 8*rm*' of the connecting member 8*r*', and the stepped portion between the front face 7*m*' of the center frame 7' and the joining face 8*lm*' of the connecting member 8*l*'.

FIG. 7B shows a second modified example in which the joining faces 8*rm*', 8*lm*' serving as the joining portions of the connecting members 8*r*', 8*l*' with the blade bracket 4Br are positioned forward of the front face 7*m*' of the center frame 7'.

In this case, cylinder fulcrum plates 4Br1, right blade fulcrum plates 4Br2, left blade fulcrum plates 4Br3, and a reinforcing plate 4Br4 of the blade bracket 4Br are formed in alignment with the stepped portion between the front face 7*m*' of the center frame 7' and the joining face 8*rm*' of the connecting member se, and the stepped portion between the front face 7*m*' of the center frame 7' and the joining face 8*lm*' of the connecting member 8*l*'.

FIG. 7C shows a third modified example in which front faces 8*rz*', 8*lz*' comprising the joining faces 8*rm*', 8*lm*' of the connecting members 8*r*, 8*l*' form continuous curved surfaces with the front face 7*m*' of the center frame 7'.

In this case, cylinder fulcrum plates 5Br1, right blade fulcrum plates 5Br2, left blade fulcrum plates 5Br3, and a reinforcing plate 5Br4 of the blade bracket 5Br are formed in alignment with the front face 7*m*' of the center frame 7', the joining face 8*rm*' of the connecting member 8*r*', and the joining face 8*lm*' of the connecting member 8*l*'.

FIG. 8 shows top views of various modified examples of the second embodiment in which blade brackets 6Br, 7Br, 8Br are joined respectively to the front face 7*m*' of the center frame 7' and the joining faces 8*rm*', 8*r*1' of the connecting members 8*r*, 8*l*' via attachment plates Tra, Tla, attachment plates Trb, Tlb, and attachment plates Trc, Tlc respectively.

Figure 8C:
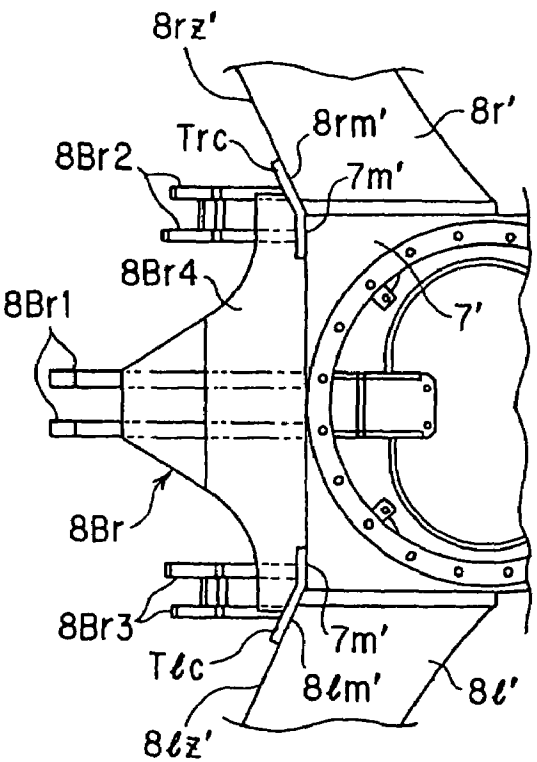
FIGS. 8A, 8B, and 8C are a top view showing a fourth modified example of the joining condition between the center frame, the connecting member, and the blade bracket in the hydraulic shovel of the second embodiment according to the present invention, a top view showing a fifth modified example thereof, and a top view showing a sixth modified example thereof.
Figure 8B:
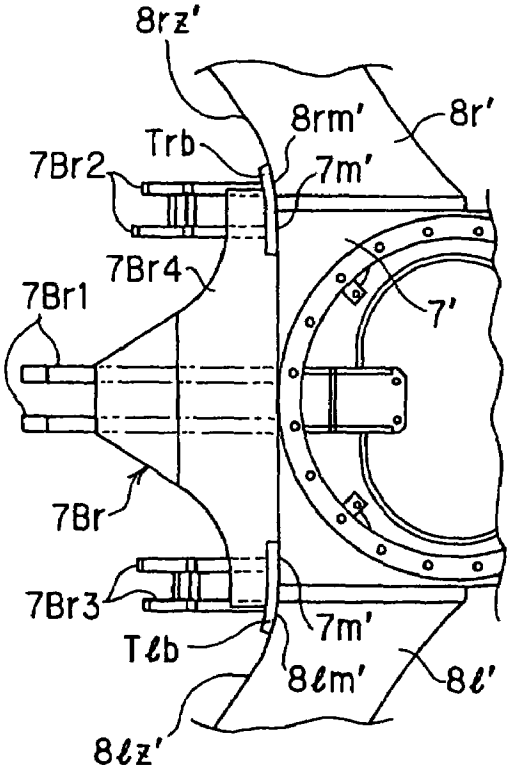
Figure 8A:
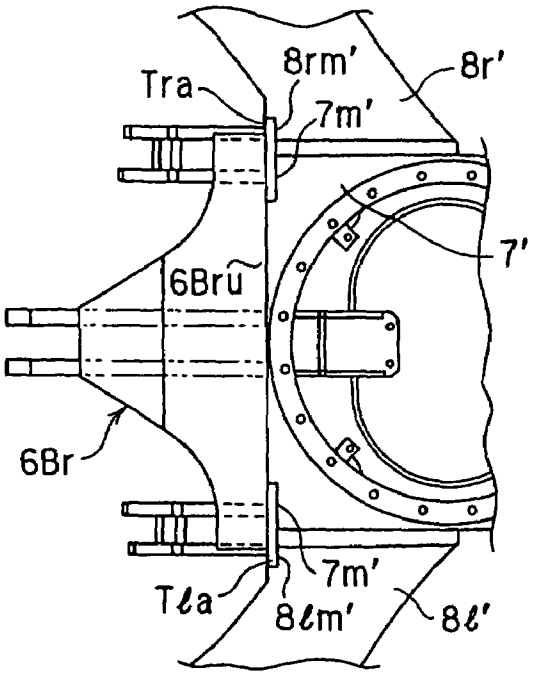
Figure 9:
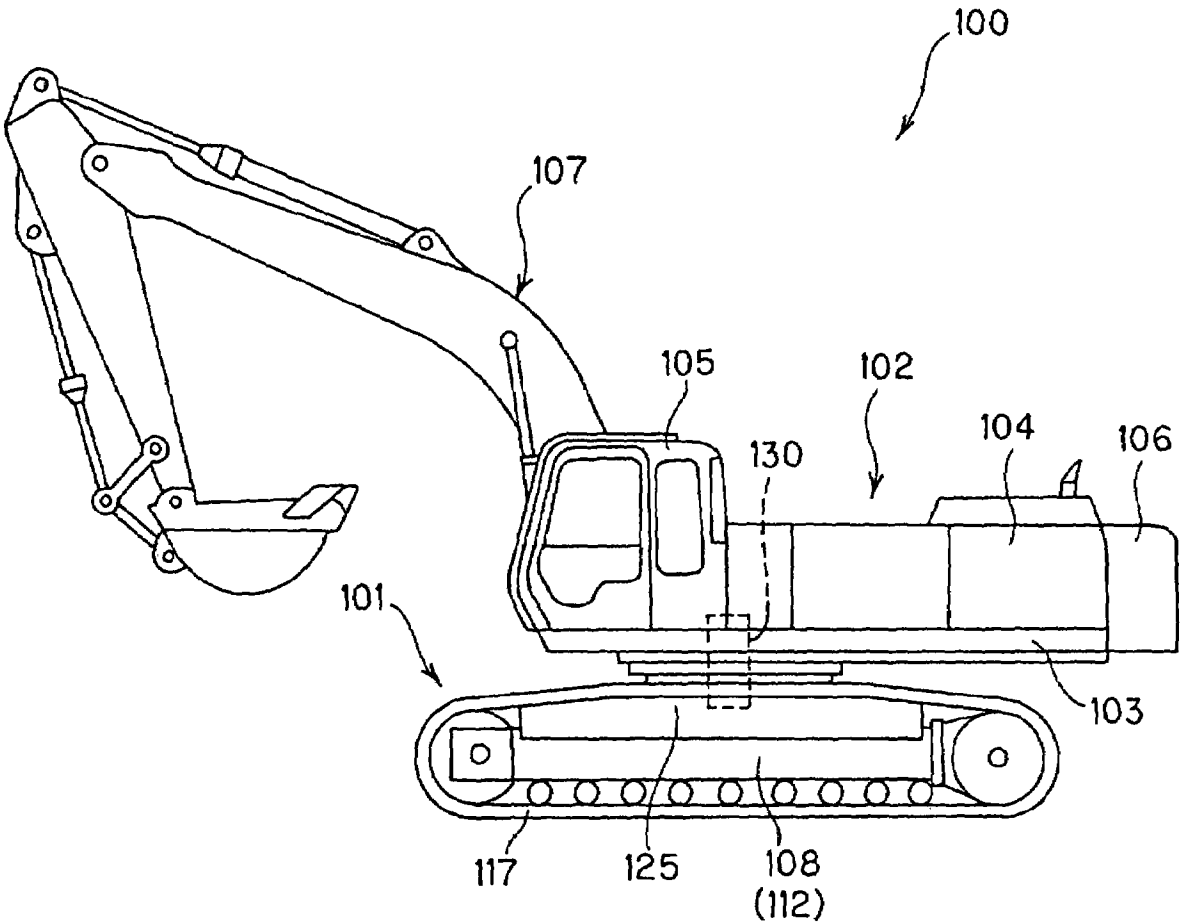
FIG. 9 PRIOR ART
FIG. 9 is a side view showing a conventional hydraulic shovel.
Figure 10B:
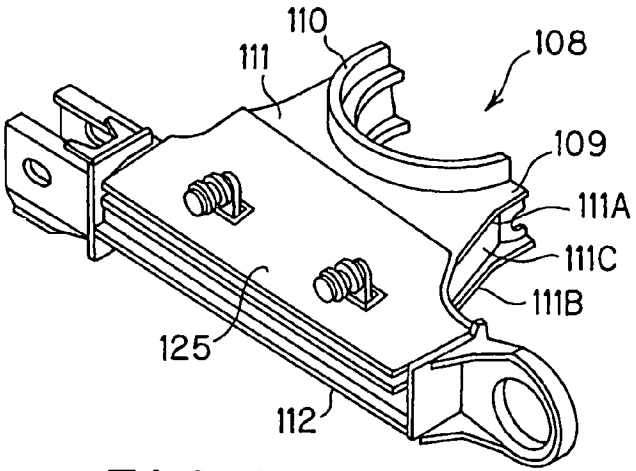
FIG.10B PRIOR ART
FIGS. 10A, 10B, and 10C are a plan view and a perspective view of a truck frame, mudguard covers, and so on in a conventional hydraulic shovel, and a sectional view along the I-I line in FIG. 10A.
Figure 10C:
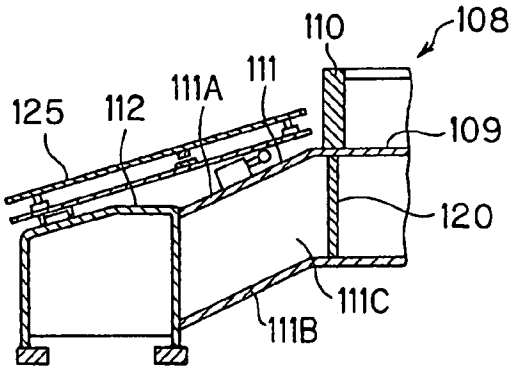
FIG.10C PRIOR ART
Figure 10A:
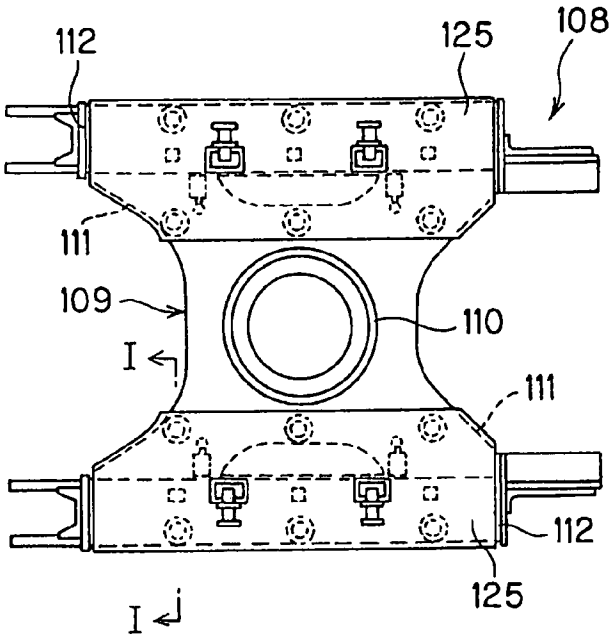
FIG.10A PRIOR ART

FIG. 8A shows a fourth modified example in which a rear face 6Bru of the blade bracket 6Br is formed as a single plane, and this blade bracket 6Br is welded via the plate-form attachment plates Tra, Tla to the front face 7*m*' of the center frame 7', the joining face 8*rm*' of the connecting member 8*r*', and the joining face 8*lm*' of the connecting member 8*l*' in which recessed portions corresponding to the attachment plates Tra, Tla are formed.

In this constitution, the rear face 6Bru of the blade bracket 6Br is formed as a single plane, thereby simplifying the constitution and manufacture of the blade bracket 6Br. As a result, the blade bracket 6Br is suited for use as a standardized component for application to various types of construction machine.

FIG. 8B shows a fifth modified example in which the front face 8*rz*' of the connecting member 8*r*' is formed as a continuous curved surface with the front face 7*m*' of the center frame 7' and joined thereto, the front face 8*lz*' of the connecting member 8*l*' is formed as a continuous curved surface with the front face 7*m*' of the center frame 7' and joined thereto, and thus the blade bracket 7Br is welded to the front face 7*m*' of the center frame 7', and the joining faces 8*rm*', 8*lm*' on the front faces 8*rz*', 8*lz*' of the connecting members 8*r*, 8*l*' via the plate-form attachment plates Trb, Tlb.

In this case, the respective rear faces of cylinder fulcrum plates 7Br1, right blade fulcrum plates 7Br2, left blade fulcrum plates 7Br3, and a reinforcing plate 7Br4 of the blade bracket 7Br take a form which corresponds with the front face 7*m*' of the center frame 7', the joining face 8*rm*' of the connecting member 8*r*', and the joining face 8*lm*' of the connecting member 8*l*', and are formed with recessed portions corresponding to the attachment plates Trb, Tlb.

FIG. 8C shows a sixth modified example in which the front face 8*rz*' of the connecting member 8*r*' is formed as a plane having an incline in relation to the front face 7*m*' of the center frame 7' and thus joined thereto, and the front face 8*lz*' of the connecting member 8*l*' is formed as a plane having an incline in relation to the front face 7*m*' of the center frame 7' and thus joined thereto. In this state, the blade bracket 8Br is welded to the front face 7*m*' of the center frame 7', the joining face 8*rm*' on the front face 8*rz*' of the connecting member 8*r*', and the joining face 8*lm*' on the front face 812 of the connecting member 8*l*' via the plate-form attachment plates Trc, Tlc.

In this case, the respective rear faces of cylinder fulcrum plates 8Br1, right blade fulcrum plates 8Br2, left blade fulcrum plates 8Br3, and a reinforcing plate 8Br4 of the blade bracket 8Br take a form which corresponds with the front face 7*m*' of the center frame 7', the joining face 8*rm*' of the connecting member 8*r*', and the joining face 8*lm*' of the connecting member 8*l*', and are formed with recessed portions corresponding to the attachment plates Trc, Tlc.

Note that in the modified examples shown in FIGS. 7, 8, examples were described in which the front face 7*m*' of the center frame 7' and the joining faces 8*rm*', 8*lm*' of the connecting members 8*r*', 8*l*' are vertical faces, but these faces may be faces other than vertical faces such as inclined faces which are inclined in relation to the vertical direction, and hence are not strictly limited to vertical faces.

Further, bolts may be used to join the blade bracket to the front face 7*m*' of the center frame T and the joining faces 8*rm*', 8*lm*' of the connecting members 8*r*, 8*l*'.

Note that in the embodiments described above, an example was described in which a hydraulic shovel is used as the construction machine, but the construction machine according to the present invention may of course be applied effectively to a machine other than a hydraulic shovel having a similar constitution.

For example, the present invention may be applied effectively to a machine other than a hydraulic shovel which has a base carrier constitution, such as a crawler dump, a bulldozer, or an agricultural machine.

What is claimed is:

1. A construction machine, comprising:

a lower traveling body having a crawler belt and a frame supporting the crawler belt;

an upper slewing body which slews freely in relation to the lower traveling body; and a blade, which is rotatably supported by the lower traveling body;

wherein the lower traveling body, includes:

a center frame integrally casted by a cast steel;

right and left truck frames, which are located on an outside of two side portions, respectively, of the center frame;

right and left connecting members, which are fixed to both the center frame and the right and left truck frames, respectively; and a blade bracket joined to the center frame and the connecting members, wherein the center frame has, on a front side thereof, a joining flat face that joins the blade bracket, each of the connecting members has, on a front side thereof, a joining face that joins the blade bracket and has a prescribed width in a vehicle-width direction, the blade bracket comprising:

a right fulcrum plate assembly that rotatably supports the blade, wherein the right fulcrum plate assembly comprises two plates, an outer fulcrum plate, which has a rear face, wherein an entirety of the rear face of the outer fulcrum plate of the right fulcrum plate assembly is joined to the joining face of the right connecting member, and an inner fulcrum plate, which has a rear face, wherein an entirety of the rear face of the inner fulcrum plate of the right fulcrum plate assembly is joined to the joining flat face of the center frame, and a left fulcrum plate assembly that rotatably supports the blade, wherein the left fulcrum plate assembly comprises two plates, an outer fulcrum plate, which has a rear face, wherein an entirety of the rear face of the outer fulcrum plate of the left fulcrum plate assembly is joined to the joining face of the left connecting member, and an inner fulcrum plate, which has a rear face, wherein an entirety of the rear face of the inner fulcrum plate of the left fulcrum plate assembly is joined to the joining flat face of the center frame, and a reinforcing plate that is joined to an upper face of the right fulcrum plate assembly and an upper face of the left fulcrum plate assembly, wherein the reinforcing plate has a rear face, and the rear face of the reinforcing plate is attached to the joining faces of the right and left connecting members and the joining flat face of the center frame.

2. The construction machine according to claim 1, wherein the front face of the center frame to which the blade bracket is joined and the front faces of the connecting members to which the blade bracket is joined form a single plane.

3. The construction machine according to claim 1, wherein the front face of the center frame to which the blade bracket is joined and the front faces of the connecting members to which the blade bracket is joined form a stepped portion.

4. The construction machine according to claim 1, wherein the connecting members to which the blade bracket are joined form a continuous surface including a curved surface in relation to the front face of the front side plate of the center frame to which the blade bracket is joined.

5. The construction machine according to claim 1, wherein the blade bracket is joined to the center frame and the connecting member via an attachment member.

6. The construction machine according to claim 2, wherein the blade bracket is joined to the center frame and the connecting member via an attachment member.

7. The construction machine according to claim 3, wherein the blade bracket is joined to the center frame and the connecting member via an attachment member.

8. The construction machine according to claim 4, wherein the blade bracket is joined to the center frame and the connecting member via an attachment member.

9. The construction machine according to claim 1, wherein the blade bracket includes a plurality of vertically extending plates and the reinforcing plate extends horizontally; the vertically extending plates respectively having upper edges and rear edges, the upper edges of the vertically extending plates being arranged in a common plane, and the rear edges of the vertically extending plates being arranged in a common plane; the blade bracket being joined to the front face of the center frame and the front faces of the left and right connecting members along the common plane of the rear edges of the vertically extending plates; the reinforcing plate being arranged in the common plane of the upper edges of the vertically extending plates, having a width larger than that of the center frame, and extending between the right and left connecting members and being joined to the upper edges of the vertically extending plates, the center frame and the right and left connecting members.

10. A construction machine comprising a lower traveling body having a crawler belt and an upper slewing body which slews freely in relation to the lower traveling body;

a blade, which is rotatably supported by the lower traveling body;

a frame of the lower traveling body supporting the crawler belt and comprising a center frame that is hollow and integrally casted by a cast steel and to which the upper slewing body is slewably attached, right and left truck frames, which are located on an outside of two side portions, respectively, of the center frame, right and left connecting members, which are hollow and fixed to both the center frame and the truck frames, respectively, and a blade bracket joined to the center frame and the connecting members, wherein the center frame has, on a front side thereof, a joining flat face that joins the blade bracket, each of the connecting members has, on a front side thereof, a joining face that joins the blade bracket and has a prescribed width in a vehicle-width direction, wherein the joining face of the blade bracket comprising:

a right fulcrum plate assembly that rotatably supports the blade, wherein the right fulcrum plate assembly comprises an outer fulcrum plate, which has a rear face, wherein an entirety of the rear face of the outer fulcrum plate of the right fulcrum plate assembly is joined to the joining face of the right connecting member, and an inner fulcrum plate, which has a rear face, wherein an entirety of the rear face of the inner fulcrum plate of the right fulcrum plate assembly is joined to the joining flat face of the center frame, and a left fulcrum plate assembly that rotatably supports the blade, wherein the left fulcrum plate assembly comprises an outer fulcrum plate, which has a rear face, wherein an entirety of the rear face of the outer fulcrum plate of the left fulcrum plate assembly is joined to the joining face of the left connecting member, and an inner fulcrum plate, which has a rear face, wherein an entirety of the rear face of the inner fulcrum plate of the left fulcrum plate assembly is joined to the joining flat face of the center frame, and a reinforcing plate that is joined to an upper face of the right fulcrum plate assembly and an upper face of the left fulcrum plate assembly, wherein the reinforcing plate has a rear face, and the rear face of the reinforcing plate is attached to the joining faces of the right and left connecting members and the joining flat face of the center frame, wherein the front face of the center frame and the front faces of the right and left connecting members form a single plane to which the blade bracket is joined, and a joining portion of the blade bracket is aligned with the front face of the center frame and the respective front faces of the right and left connecting members and welded thereto, whereby the blade bracket is joined to the center frame and the right and left connecting members.

11. The construction machine according to claim 10, wherein the blade bracket includes a plurality of vertically extending plates and the reinforcing plate extends horizontally; the vertically extending plates respectively having upper edges and rear edges, the upper edges of the vertically extending plates being arranged in a common plane, and the rear edges of the vertically extending plates being arranged in a common plane; the blade bracket being joined to the front face of the center frame and the front faces of the left and right connecting members along the common plane of the rear edges of the vertically extending plates; the reinforcing plate being arranged in the common plane of the upper edges of the vertically extending plates and extending between the right and left connecting members and being joined to the upper edges of the vertically extending plates, the center frame and the right and left connecting members.

12. A construction machine comprising:

a lower traveling body having a crawler belt and an upper slewing body which slews freely in relation to the lower traveling body;

a blade, which is rotatably supported by the lower traveling body;

the lower traveling body supporting the crawler belt and comprising:

a center frame that is hollow and integrally casted by a cast steel, and to which the upper slewing body is slewably attached, right and left truck frames, which are located on an outside of two side portions, respectively, of the center frame, right and left connecting members, which are hollow and fixed to both the center frame and the right and left truck frames, respectively, and a blade bracket joined to the center frame and the connecting members, wherein the center frame has, on a front side thereof, a joining flat face that joins the blade bracket, each of the connecting members has, on a front side thereof, a joining face that joins the blade bracket and has a prescribed width in a vehicle-width direction, the bracket comprising:

a right fulcrum plate assembly that rotatably supports the blade, wherein the right fulcrum plate assembly comprises, an outer fulcrum plate, which has a rear face, wherein an entirety of the rear face of the outer fulcrum plate of the right fulcrum plate assembly is joined to the joining face of the right connecting member, and an inner fulcrum plate, which has a rear face, wherein an entirety of the rear face of the inner fulcrum plate of the right fulcrum plate assembly is joined to the joining flat face of the center frame, and a left fulcrum plate assembly that rotatably supports the blade, wherein the left fulcrum plate assembly comprises an outer fulcrum plate, which has a rear face, wherein an entirety of the rear face of the outer fulcrum plate of the left fulcrum plate assembly is joined to the joining face of the left connecting member, and an inner fulcrum plate, which has a rear face, wherein an entirety of the rear face of the inner fulcrum plate of the left fulcrum plate assembly is joined to the joining flat face of the center frame, and a reinforcing plate that is joined to an upper face of the right fulcrum plate assembly and an upper face of the left fulcrum plate assembly, wherein the reinforcing plate has a rear face, and the rear face of the reinforcing plate is attached to the joining faces of the right and left connecting members and the joining flat face of the center frame;

the construction machine further comprising plate-form attachment members interposed respectively between the blade bracket and a portion of the front face of the center frame and the front faces of the right and left connecting members, wherein the front face of the center frame and the front faces of the right and left connecting members define a single plane, and the blade bracket is welded to the center frame and the right and left connecting members via the plate-form attachment members.

13. The construction machine according to claim 12, wherein the blade bracket includes a plurality of vertically extending plates and the reinforcing plate extends horizontally; the vertically extending plates respectively having upper edges and rear edges, the upper edges of the vertically extending plates being arranged in a common plane, and the rear edges of the vertically extending plates being arranged in a common plane; the blade bracket being joined to the front face of the center frame and the front faces of the left and right connecting members along the common plane of the rear edges of the vertically extending plates; the reinforcing plate being arranged in the common plane of the upper edges of the vertically extending plates and extending between the right and left connecting members and being joined to the upper edges of the vertically extending plates, the center frame and the right and left connecting members.

14. A construction machine comprising:

a lower traveling body having a crawler belt;

an upper slewing body, which slews freely in relation to the lower traveling body, and a blade, which is rotatably supported by the lower traveling body, wherein the lower traveling body includes a frame supporting the crawler belt, and the frame includes a center frame that is hollow and integrally casted with a cast steel, and to which the upper slewing body is slewably attached, the construction machine further comprises:

right and left truck frames, which are located on an outside of two side portions, respectively, of the center frame;

right and left connecting members that are hollow and fixed to both the center frame and the truck right and left frames, respectively;

a blade bracket joined to the center frame and the connecting members, wherein the center frame has, on a front side thereof, a joining flat face that joins the blade bracket, wherein each of the connecting members has, on a front side thereof, a joining face that joins the blade bracket and has a prescribed width in a vehicle-width direction, wherein the blade bracket is joined to a front face of the center frame and respective front faces of the two of the connecting members and has a reinforcing plate that extends in a lateral direction of the lower traveling body between the center frame and the right and left truck frames, wherein the blade bracket comprises:

a right fulcrum plate assembly that rotatably supports the blade, wherein the right fulcrum plate assembly comprises an outer fulcrum plate, which has a rear face, wherein an entirety of the rear face of the outer fulcrum plate of the right fulcrum plate assembly is joined to the joining face of the right connecting member, and an inner one of the two plates fulcrum plate, which has a rear face, wherein an entirety of the rear face of the inner fulcrum plate of the right fulcrum plate assembly is joined to the joining flat face of the center frame, and a left fulcrum plate assembly that rotatably supports the blade, wherein the left fulcrum plate assembly comprises an outer fulcrum plate, which has a rear face, wherein an entirety of the rear face of the outer fulcrum plate of the left fulcrum plate assembly is joined to the joining face of the left connecting member, and an inner fulcrum plate, which has a rear face, wherein an entirety of the rear face of the inner fulcrum plate of the left fulcrum plate assembly being joined to the joining flat face of the center frame and, an attachment member having a plane to which a joining portion of the blade bracket is welded, wherein the front face of the center frame is welded to the attachment member, the front faces of the connecting members are adjacent to the front face of the center frame and are welded to the attachment member, and the attachment member is interposed between and welded to the blade bracket the center frame and the right and left connecting members.

15. The construction machine according to claim 14, wherein the reinforcing plate is arranged above the fulcrum plate assemblies and is joined to the center frame.

16. The construction machine according to claim 14, wherein the blade bracket includes a plurality of vertically extending plates and the reinforcing plate extends horizontally; the vertically extending plates respectively having upper edges and rear edges, the upper edges of the vertically extending plates being arranged in a common plane, and the rear edges of the vertically extending plates being arranged in a common plane; the blade bracket being joined to the front face of the center frame and the front faces of the left and right connecting members along the common plane of the rear edges of the vertically extending plates; the reinforcing plate being arranged in the common plane of the upper edges of the vertically extending plates and extending between the right and left connecting members and being joined to the upper edges of the vertically extending plates, the center frame and the right and left connecting members.

17. The construction machine according to claim 14, wherein the reinforcing plate is joined to an upper face of the right fulcrum plate assembly and an upper face of the left fulcrum plate assembly, and wherein the reinforcing plate is attached to the joining faces of the right and left connecting members and the joining flat face of the center frame.

* * * * *

UNITED STATES PATENT AND TRADEMARK OFFICE

CERTIFICATE OF CORRECTION

PATENT NO. : 7,730,647 B2
APPLICATION NO. : 10/848411
DATED : June 8, 2010
INVENTOR(S) : Yoshiteru Kubo et al.

It is certified that error appears in the above-identified patent and that said Letters Patent is hereby corrected as shown below:

Title page, item (73) should read

(73) Assignees: KOMATSU LTD., Tokyo (JP);
KOMATSU UTILITY CO., LTD., Tokyo (JP);
HITACHI CONSTRUCTION MACHINERY CO., LTD., Tokyo (JP).

Signed and Sealed this
Twenty-seventh Day of November, 2012

David J. Kappos

David J. Kappos
*Director of the United States Patent and Trademark Office*